US006724155B1

(12) United States Patent
Flory, IV et al.

(10) Patent No.: US 6,724,155 B1
(45) Date of Patent: Apr. 20, 2004

(54) LAMP IGNITION CIRCUIT FOR LAMP DRIVEN VOLTAGE TRANSFORMATION AND BALLASTING SYSTEM

(75) Inventors: Isaac L. Flory, IV, Blacksburg, VA (US); Christopher A. Hudson, Christiansburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/406,547

(22) Filed: Dec. 20, 1999

Related U.S. Application Data

(63) Continuation-in-part of application No. 08/968,093, filed on Nov. 12, 1997, now Pat. No. 5,962,988, which is a continuation-in-part of application No. 08/556,878, filed on Nov. 2, 1995, now Pat. No. 5,825,139.

(51) Int. Cl.[7] ..... H05B 37/00

(52) U.S. Cl. ..... 315/289; 315/290; 315/291; 315/209 CD; 315/244; 315/246; 315/239; 315/DIG. 5

(58) Field of Search ..... 315/289, 290, 315/291, 244, 282, 276, 209 CD, 240, 239, 242, 243, 245, 219, 127, 246, DIG. 5

(56) References Cited

U.S. PATENT DOCUMENTS

| | | | | |
|---|---|---|---|---|
| 4,015,167 A | | 3/1977 | Samuels | 315/99 |
| 4,165,475 A | * | 8/1979 | Pegg et al. | 315/99 |
| 4,695,771 A | * | 9/1987 | Hallay | 315/290 |
| 4,958,107 A | | 9/1990 | Mattas et al. | 315/289 |
| 5,047,694 A | | 9/1991 | Nuckolls et al. | 315/290 |
| 5,289,083 A | | 2/1994 | Quazi | 315/224 |
| 5,289,084 A | | 2/1994 | Nuckolls et al. | 315/247 |
| 5,321,338 A | | 6/1994 | Nuckolls et al. | 315/290 |
| 5,708,330 A | | 1/1998 | Rothenbuhler et al. | 315/244 |
| 5,825,139 A | | 10/1998 | Nuckolls et al. | 315/307 |

* cited by examiner

*Primary Examiner*—Haissa Philogene
(74) *Attorney, Agent, or Firm*—Alfred N. Goodman; Stacey J. Longanecker

(57) ABSTRACT

A lamp ignition circuit is provided which can initiate operation of a gas discharge lamp using a driving voltage which is similar in magnitude to the lamp operating voltage. The lamp ignition circuit is useful with a semi-resonant ballast and lamp circuit in which switching operations intrinsic to the lamp shock-excite a series-connected inductor and capacitor into semi-resonant operation corresponding to an energy exchange and transfer during each half-cycle of the alternating current source to drive the lamp to start and maintain operation of the lamp using line voltage. The ignitor circuit has a disabling function following ignition of the lamp which is operable when the operating voltage of the lamp is approximately the line voltage of the power source. The disabling function triggered by an increase in voltage across the ignition circuit following operation of the lamp.

12 Claims, 2 Drawing Sheets

LAMP IGNITION CIRCUIT FOR LAMP DRIVEN VOLTAGE TRANSFORMATION AND BALLASTING SYSTEM

This is a continuation-in-part application of prior U.S. patent application Ser. No. 08/968,093, originally filed Nov. 12, 1997, now U.S. Pat. No. 5,962,988, which is a continuation-in-part of U.S. application Ser. No. 08/556,878, filed Nov. 2, 1995 (now U.S. Pat. No. 5,825,139), both of which are incorporated herein by reference.

FIELD OF THE INVENTION

The invention relates to a lamp ignition circuit having a disabling function which operates with a low-wattage discharge semi-resonant ballast and lamp circuit. Further, the invention relates to a lamp ignition circuit, the disabling function of which does not require the lamp operating voltage to be considerably higher than the ballast open-circuit voltage during lamp run conditions.

BACKGROUND OF THE INVENTION

A low-wattage discharge lamp circuit which provides lamp-driven voltage transformation and ballasting is described in U.S. Pat. No. 5,825,139 (commonly assigned to Hubbell Incorporated). The lamp circuit described therein uses the discharge breakdown mechanism of the lamp itself at least once each half-cycle to excite a series-connected inductance and capacitance into ringing up to an instantaneous and root mean square (RMS) open circuit voltage (OCV) of approximately twice the input line voltage to drive the discharge lamp. This is in contrast with a conventional gas discharge lamp circuit which supplies higher voltage to the lamp to maintain operation. For example, a conventional gas discharge lamp circuit is typically provided with a semiconductor switching device to augment the source voltage to provide the required lamp ignition voltage.

The measured lamp operating voltage of the lamp circuit described in U.S. Pat. No. 5,825,139 is higher than the line voltage because the lamp itself facilitates its own driving voltage. The lamp circuit is advantageous because it does not require such switching circuits as the aforementioned semiconductor switching device and therefore requires fewer components. Instead, switching operations intrinsic to the lamp shock-excite the inductance and the capacitance into an energy exchange and transfer during each half-cycle at a higher frequency than the frequency of the AC source connected to the lamp circuit. The circuit values for the inductance and capacitance are chosen to allow this semi-resonant operation. In other words, these circuit reactors are different from self-resonant reactors because they are resonant when the switching lamp excites them and therefore are capable of being shocked by the switching action of the lamp. Accordingly, the lamp circuit described in U.S. Pat. No. 5,825,139 is hereinafter referred to as a semi-resonant ballast and lamp circuit.

A lamp starting circuit or ignitor is normally present in a lamp circuit and is typcially switched out of operation, or its influence on the lamp circuit is minimized, by the lamp entering a normal operating mode. Conventional ignitors do not function properly with the semi-resonant ballast and lamp circuit described in U.S. Pat. No. 5,825,139 because they depend upon the lamp operating voltage being considerably lower than the ballast OCV. A need therefore exists for an ignition circuit which can ignite a lamp in a semi-resonant ballast using substantially the line voltage. A need also exists for an ignition circuit which does not require an operational distinction such as the significant difference between the instantaneous OCV and the lamp operating voltage used to provide or withhold ignition pulses in conventional ignitor circuits.

SUMMARY OF THE INVENTION

In accordance with the present invention, a lamp ignition circuit is provided which can start and maintain operation of a gas discharge lamp using only line voltage as the activating electromotive force.

In accordance with an aspect of the present invention, a lamp ignition circuit for a semi-resonant ballast and lamp circuit is provided which does not require an operational distinction such as a significant difference between the instantaneous OCV and the lamp operating voltage to provide or withhold ignition pulses as do conventional ignitor circuits.

In accordance with another aspect of the present invention, a lamp ignition circuit is provided which has a disabling function triggered by an increase in voltage across the ignition circuit following operation of the lamp.

A discharge lamp circuit comprises: (1) a discharge lamp operable from an alternating current power source; (2) an inductor; (3) a first capacitor, the inductor, the lamp and the capacitor being connected in series; and (4) an ignitor circuit connected at one end thereof to a first node between the inductor and the lamp and connected at the other end thereof to a second node between the capacitor and the power source. Switching operations intrinsic to the lamp shock-excite the inductor and the capacitor into semi-resonant operation corresponding to an energy exchange and transfer during each half-cycle of the alternating current source to drive the lamp to start and maintain operation of the lamp using line voltage. The ignitor circuit has a disabling function following ignition of the lamp which is operable when the operating voltage of the lamp is approximately the line voltage of the power source.

In accordance with another embodiment of the present invention, an ignitor circuit for a semi-resonant ballast and lamp circuit is provided. The semi-resonant ballast and lamp circuit is operable to use switching operations intrinsic to a discharge lamp to shock-excite a series-connected inductor and capacitor into an energy exchange and transfer during each half-cycle of an alternating current source providing power to the semi-resonant ballast and lamp circuit to start and maintain operation of the lamp using line voltage. The ignitor circuit comprises: (1) a second capacitor; (2) a capacitor charging circuit for charging the second capacitor with an offset voltage; and (3) a pulse generator circuit for generating pulses via discharging of the second capacitor to ignite the lamp when combined with the offset voltage and line voltage from the power source. The pulse generator circuit is connected at one end thereof to a first terminal of the second capacitor. The second capacitor is connected at a second terminal thereof to a first node between the inductor and a first terminal of the lamp. The pulse generator circuit is connected at another end thereof at a second node between the capacitor and the power source. The pulse generating circuit is rendered ineffective for igniting the lamp when voltage across the first node and the second node increases during operation of the lamp. A disabling circuit is provided for the ignitor circuit which is triggered by a voltage corresponding to the root mean square voltage of the power source.

In accordance with yet another embodiment of the present invention, an ignitor circuit for a semi-resonant ballast and lamp circuit comprises: (1) a resistor and a second capacitor connected in a series circuit and across the lamp; (2) a transformer having a primary winding and a secondary winding; (3) a breakover device; and (4) third capacitor connected at one terminal thereof to respective first terminals of the primary winding and the secondary winding and at the other terminal thereof to a return path of the lamp to the power source, the breakover device having a terminal connected to the second terminal of the primary winding and another terminal connected to the series circuit, the second terminal of the secondary winding being connected to the supply side of the lamp. The second capacitor charges through the resistor until a breakover voltage corresponding to the breakover device is reached. The second capacitor discharges through the primary winding to allow the transformer to generate a pulse for igniting the lamp using substantially the line voltage.

BRIEF DESCRIPTION OF DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
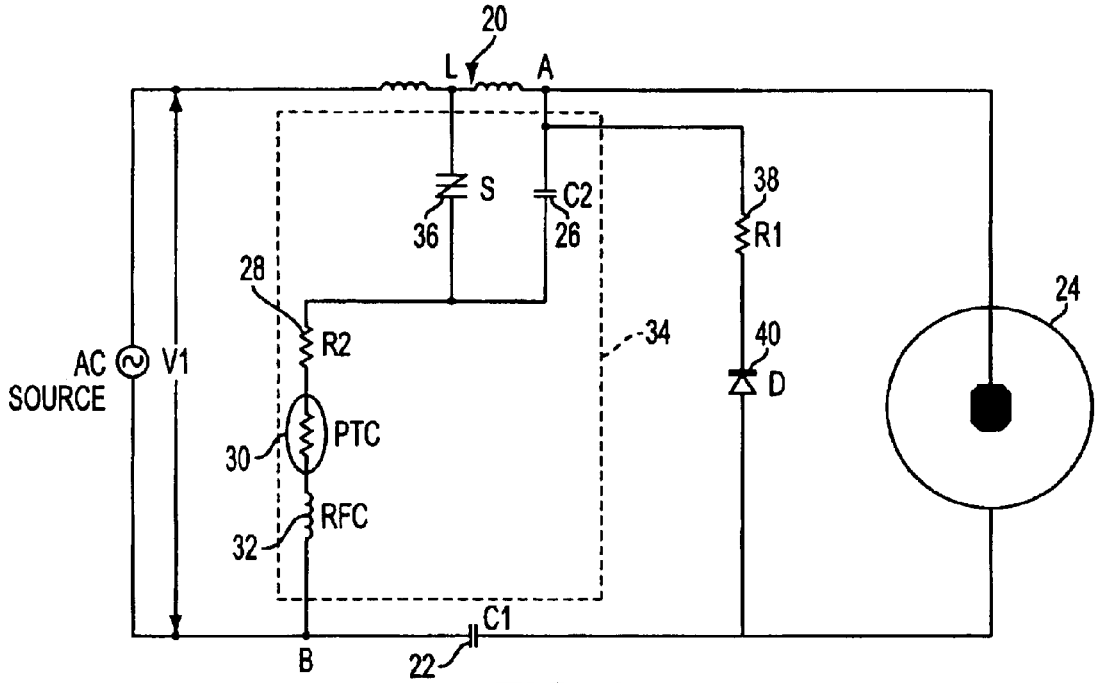
FIG. 1 is a schematic diagram of a semi-resonant ballast and lamp circuit having an ignitor circuit constructed in accordance with an embodiment of the present invention.

In order for a lamp to strike, the lamp requires sufficient OCV from a ballast. FIG. 1 depicts a semi-resonant ballast and lamp circuit as described in U.S. Pat. No. 5,825,139 comprising a series-connected inductance 20, lamp 24 and capacitance 22. The semi-resonant ballast and lamp circuit is operated from, but not limited to, a 120 volt RMS line voltage and is therefore incapable of supplying sufficient OCV for the lamp to strike. An ignitor circuit is provided as an auxiliary circuit branch and comprises a resistor 38 and a diode 40 to charge the series resonant capacitor 22 with DC offset voltage. The value of the resistor 38 is selected such that the combination of the offset and the AC line voltage with ignitor pulses provides sufficient OCV for the lamp to ignite. In accordance with the present invention, ignitor circuits 34, 50 and 80 are described below in connection with FIGS. 1, 2 and 3, respectively, to provide ignitor pulses for a semi-resonant ballast and lamp circuit in which the ignitor starts and the ballast maintains operation of a gas discharge lamp using line voltage, and which do not require an operational distinction such as a significant difference between the instantaneous OCV and the lamp operating voltage to provide or withhold ignition pulses, as in conventional ignitor circuits.

With reference to FIG. 1, the inductor 20 and series capacitor 22 are both selected to provide ballasting to operate the lamp as described in the U.S. Pat. No. 5,825,139 incorporated herein by reference. The instantaneous OCV of the lamp and ballast circuit arrangement depicted in FIG. 1 is the input voltage V1. An advantage of this semi-resonant ballast and lamp circuit is the ability to drive the discharge lamp 24 with a relatively low input voltage without the use of an autotransformer ballast, which can significantly improve the overall efficiency of the ballast circuit. Since conventional ignitors use the difference between the instantaneous OCV and the lamp operating voltage to provide or withhold starting pulses, their use presents problems in connection with a lamp and semi-resonant ballast circuit as shown in FIG. 1. This is because the lamp voltage of the lamp and ballast circuit configuration in FIG. 1 is approximately the line voltage and therefore does not provide adequate means for making an operational distinction for use with a conventional ignitor. The semi-resonant ballast and lamp circuit of FIG. 1, however, presents a significance difference between the voltage across the ignitor (i.e., $V_{AB}$) during open circuit conditions and during operation of the lamp. For example, a 150 watt metal halide (MH) lamp circuit being operated from a 120 VAC power supply presents a 67 volt $V_{RMS}$ difference between $V_{AB}$ during open circuit and operating states. The semi-resonant ballast and lamp circuit in FIG. 1 is unique in that the voltage $V_{AB}$ is higher during lamp operation, which is in contrast with the voltage being lower during lamp operating conditions in a standard ballast and ignitor configuration.

With continued reference to FIG. 1, the capacitor 26 is charged each half-cycle of the input voltage through a resistor 28, a positive temperature coefficient (PTC) resistor 30 and a radio frequency choke (RFC) 32. The resistor 28 sets the time constant for determining the number of pulses per half-cycle. The RFC 32 decouples the ignitor circuit 34 from the high frequency pulse that it is generating. When the capacitor 26 reaches an instantaneous voltage that is substantially equal to the breakover voltage of a sidac 36, the sidac 36 conducts and discharges the energy stored in the capacitor 26. This energy is transferred through the tapped ballast inductor 20 and appears across the lamp terminals in the form of a high voltage pulse. The high frequency impedance of the capacitor 22 is low and has nominal effect on the high frequency, high voltage ignitor pulse. The PTC 30 is chosen to have a trip current above the current required for ignitor operation during open circuit conditions. Unlike conventional lamp and ignitor circuits, when the lamp 24 has begun operating, the voltage across the ignitor circuit 34 rises and the current passing through the ignitor circuit 34 increases. If the PTC trip current is then exceeded, the PTC self-heats, causing the resistance therein to rise to a level where the capacitor 26 does not charge to the breakover level of the sidac 36. Accordingly, the ignitor circuit 34 ceases to function.

By way of an example, for a 150 W MH, 120 VAC lamp and ballast circuit, the following circuit values in Table 1 are applicable.

TABLE 1

| Ignitor Circuit Components of FIG. 1 |
|---|
| L = 118 millihenries |
| C1 = 27 microfarads |
| D = 2000 V, 0.25A (rectifier) |
| R1 = 33,000 ohms |
| C2 = 0.22 microfarads |
| S = 150 V (sidac) |
| R2 = 2000 ohms |
| PTC = 180 ohms @ 25 C, $I_{TRIP}$ = 70 milliamps |
| RFC = 55 millihenries |

Figure 2:
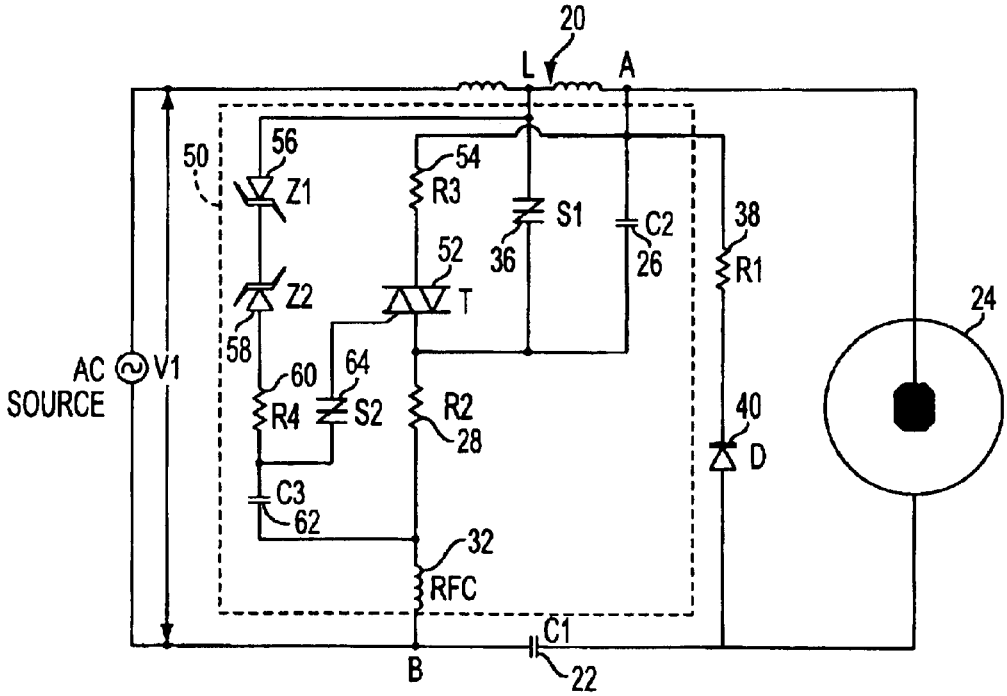
FIG. 2 is a schematic diagram of a semi-resonant ballast and lamp circuit having an ignitor circuit constructed in accordance with an embodiment of the present invention.

The semi-resonant ballast and lamp circuit in FIG. 2 illustrates another ignitor circuit which uses the significant difference between $V_{AB}$ during lamp run and open circuit conditions to disable the ignitor circuitry. The semi-resonant ballast and lamp circuit operate as described in the aforementioned U.S. Pat. No. 5,825,139. The semi-resonant ballast and lamp circuit has an ignitor circuit 50 which is more advantageous than the ignitor circuit 34 depicted in FIG. 1 because it does not rely on the thermal characteristics of a single component as does the ignitor circuit 34. The ignitor components including the diode 40, the resistor 38, the capacitor 26, the resistor 28, the RFC 32 and the sidac 36 operate in the same manner as described in connection with FIG. 1.

With continued reference to FIG. 2, a bi-directional thyristor 52 and series resistor 54 are provided across the capacitor 26. A thyristor trigger circuit is also provided which comprises zener diodes 56 and 58, a resistor 60, the capacitor 62 and another sidac 64. During a non-operating lamp condition, the voltage $V_{AB}$ is approximately 125 $V_{RMS}$, which is not adequate to cause zener diodes 56 and 58 to conduct. When the lamp 24 begins to operate, however, the voltage $V_{AB}$ increases to approximately 213 $V_{RMS}$, which is sufficient to turn on the zener diodes 56 and 58. Under this higher voltage condition for $V_{AB}$, the capacitor 62 charges through the resistor 60 until the voltage across the capacitor 62 reaches the breakover voltage of the sidac 64. The sidac 64 then conducts, which activates the bi-directional thyristor 52. The thyristor 52 then discharges energy stored in the capacitor 26 through the resistor 54. The overall result is that the capacitor 26 does not store enough energy to activate the sidac 36; therefore, no high voltage ignitor pulses are generated when the lamp begins to operate based on the difference between the voltage $V_{AB}$ during open circuit and lamp operating conditions. Table 2 provides exemplary values for the ignitor circuit depicted in FIG. 2.

TABLE 2

| Ignitor Circuit Components of FIG. 2 |
|---|
| R1 = 33,000 ohms |
| R2 = 2,500 ohms |
| R3 = 10 ohms |
| R4 = 1,500 ohms |
| L = 118 millihenries |
| C1 = 27 microfarads |
| C2 = 0.22 microfarads |
| C3 = 0.1 microfarads |
| S1 = 150V (sidac) |
| S2 = 150V (sidac) |
| T = 400 V, 6A (triac) |
| D = 2000 V, 0.25A (rectifier) |
| RFC = 55 millihenries |
| Z1 = 200 V (zener diode) |
| Z2 = 200V (zener diode) |

Another embodiment for a low wattage ignitor circuit for a semi-resonant ballast and lamp circuit will now be described with reference to FIG. 3. The semi-resonant ballast and lamp circuit comprises an inductor 82 and a series connected capacitor 84 with a lamp 24. The inductor 82 and the capacitor 84 are operable to be semi-resonant at a frequency higher than the frequency of the AC power source such that, after the lamp has been ignited, the lamp 24 switches and causes a semi-resonant energy exchange with the reactances of components 82 and 84 thereby maintaining the lamp 24 at a stable operating condition up to full rated wattage, as described in the aforementioned U.S. Pat. No. 5,825,139.

Figure 3:
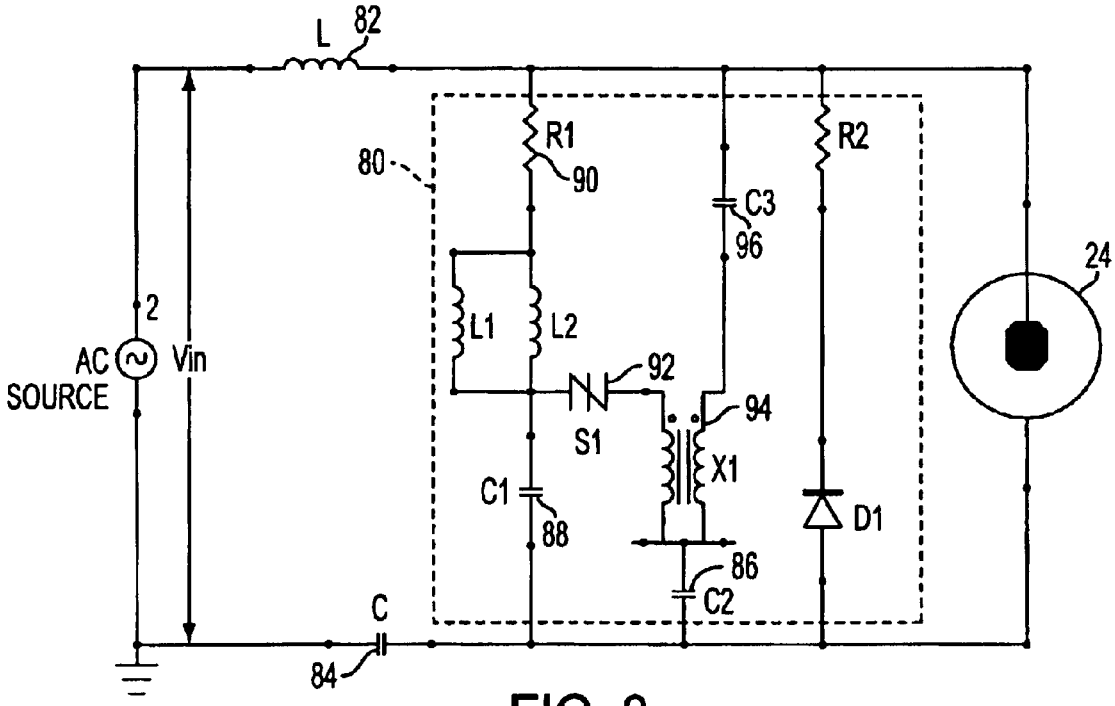
FIG. 3 is a schematic diagram of a semi-resonant ballast and lamp circuit having an ignitor circuit constructed in accordance with an embodiment of the present invention.

With continued reference to FIG. 3, a back-charge is created on a capacitor 86 from the charging of the series capacitor 84 in the semi-resonant ballast circuit via the resistor R2 and the diode D1. This back-charge provides the capacitor 88 with the ability to be charged through the resistor 90 so that the sidac 92 can breakover in both the positive and negative half-cycles over the standard input voltage range. When the sidac 92 breaks over, the charge stored in the capacitor 88 is discharged through the primary winding of the transformer 94. The transformer 94 transforms this current pulse into a high voltage pulse. The capacitor 96 decouples low frequency AC and DC voltage from passing through the secondary winding of the transformer 94. This transformation can occur several times per half-cycle of the 60 hertz line voltage. The high voltage pulses generated via the ignitor circuit 80 are of sufficient magnitude to ionize the arc tube of the gas discharge lamp 24. This provides the ability to start and maintain operation of a gas discharge lamp using the line voltage.

The inductors L1 and L2 in FIG. 3 are used to subdue the loading effect of the resistor 90 and the capacitor 88 have on the high-voltage pulse. Both of the inductors L1 and L2 are used in order to overcome current limitations of the component. The inductors L1 and L2 divide the total current from the resistor 90 and the capacitor 88 so that each inductor can handle their respective amounts of current without overheating. The capacitor 86 is depicted as being attached to both the primary and the secondary common leads of the pulse transformer 94 due to the internal component connection. The transformer, however, can be a 3-lead or a 4-lead transformer without affecting circuit operation.

The ignitors 34 and 50 in FIGS. 1 and 2, respectively, are preferably used with an inductor-lamp-capacitor circuit configuration. Further, the leads of the ignitor are preferably provided across the lamp 24 and the capacitor 22 in order to obtain the voltage of both the lamp 24 and the capacitor 22. The ignitor 80 in FIG. 3 is preferably used with either an inductor-lamp-capacitor circuit configuration or a capacitor-lamp-inductor circuit configuration.

Although the present invention has been described with reference to preferred embodiments thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. An ignitor circuit for a semi-resonant ballast and lamp circuit connected to a power source, the semi-resonant ballast and lamp circuit being operable to use switching operations intrinsic to a discharge lamp to shock-excite a series-connected inductor and capacitor into an energy exchange and transfer during each half-cycle of an alternating current source providing power to the semi-resonant ballast and lamp circuit to start and maintain operation of said lamp using line voltage, the ignitor circuit comprising:

a second capacitor;

a capacitor charging circuit for charging said second capacitor with an offset voltage;

a pulse generator circuit for generating pulses via discharging of said second capacitor to ignite said lamp when combined with said offset voltage and line voltage from said power source, said pulse generator circuit being connected at one end thereof to a first terminal of said second capacitor, said second capacitor being connected at a second terminal thereof to a first node between said inductor and a first terminal of said lamp, said pulse generator circuit being connected at another end thereof at a second node between said capacitor and said power source;

wherein said pulse generating circuit is rendered ineffective for igniting said lamp when voltage across said first node and said second node increases during operation of said lamp.

2. An ignitor circuit as claimed in claim 1, further comprising a disable circuit for said pulse generator circuit comprising:

a thyristor device;

a resistor connected in series with said thyristor device, said resistor and said thyristor being connected across said second capacitor; and a trigger circuit for said thyristor device, said trigger circuit selected to be turned on when said voltage across said first node and said second node increases to a selected value to activate said thyristor, said thyristor being operable to discharge energy stored in said second capacitor to prevent said second capacitor from operating said pulse generating circuit.

3. An ignitor circuit as claimed in claim 2, wherein said selected value corresponds to the root mean square voltage of said power source.

4. A discharge lamp circuit comprising:

a discharge lamp operable from an alternating current power source;

an inductor;

a first capacitor, said inductor, said lamp and said capacitor being connected in series; and an ignitor circuit connected at one end thereof to a first node between said inductor and said lamp and connected at the other end thereof to a second node between said capacitor and said power source;

wherein switching operations intrinsic to said lamp shock-excite said inductor and said capacitor into semi-resonant operation corresponding to an energy exchange and transfer during each half-cycle of said alternating current source to drive said lamp to start and maintain operation of said lamp using line voltage, said ignitor circuit having a disabling function following ignition of said lamp which is operable when the operating voltage of said lamp is approximately the line voltage of said power source.

5. A discharge lamp circuit as claimed in claim 4, wherein operation of said disabling function does not require said operating voltage of said lamp to be significantly higher than the open circuit voltage of said discharge lamp circuit.

6. A discharge lamp circuit as claimed in claim 4, wherein said ignitor circuit comprises:

a second capacitor;

a capacitor charging circuit for charging said second capacitor with an offset voltage;

a pulse generator circuit for generating pulses via discharging of said second capacitor to ignite said lamp when combined with said offset voltage and line voltage from said power source, said pulse generator circuit being connected at one end thereof to a first terminal of said second capacitor, said second capacitor being connected at a second terminal thereof to said first node, said pulse generator circuit being connected at another end thereof to said second node.

7. A discharge lamp circuit as claimed in claim 6, wherein said pulse generating circuit is rendered ineffective for igniting said lamp when voltage across said first node and said second node increases during operation of said lamp.

8. A discharge lamp circuit as claimed in claim 6, wherein said pulse generating circuit comprises:

a resistor through which said second capacitor is charged;

a breakdown device connected in parallel with respect to said capacitor and at least a portion of said inductor, said breakdown device conducting and discharging energy stored in said second capacitor when said second capacitor is charged to a breakover voltage corresponding to said breakdown device to generate a pulse for said lamp.

9. A discharge lamp circuit as claimed in claim 6, wherein said ignitor circuit comprises a thermally-sensitive resistive device connected in series with said resistive device, said thermally-sensitive device having a trip current and becoming a large impedance to provide said disabling function when said trip current is exceeded, said trip current being exceeded when said lamp is operating and voltage across said ignitor circuit increases.

10. An ignitor circuit for a semi-resonant ballast and lamp circuit connected to a power source, the semi-resonant ballast and lamp circuit being operable to use switching operations intrinsic to a discharge lamp to shock-excite a series-connected inductor and capacitor into an energy exchange and transfer during each half-cycle of an alternating current source providing power to the semi-resonant ballast and lamp circuit to start and maintain operation of said lamp using line voltage, the ignitor circuit comprising:

a resistor and a second capacitor connected in a series circuit and across said lamp;

a transformer having a primary winding and a secondary winding; and a breakover device having a terminal connected to the second terminal of said primary winding and another terminal connected to said series circuit, the second terminal of said secondary winding being connected to the supply side of said lamp;

wherein said second capacitor charges through said resistor until a breakover voltage corresponding to said breakover device is reached, said second capacitor discharging through said primary winding to allow said transformer to generate a pulse for igniting said lamp using only substantially said line voltage.

11. An ignitor circuit as claimed in claim 10, further comprising a third capacitor connected at one terminal thereof respective first terminals of said primary winding and said secondary winding and at the other terminal thereof to a return path of said lamp to said power source, said third capacitor allowing said second capacitor to charge so that said breakover device can breakover in postive and negative half-cycles of said power source.

12. A method of operating a discharge lamp in a semi-resonant ballast and lamp circuit connected to an alternating current power source comprising the steps of:

igniting said lamp using an ignitor, said semi-resonant ballast and lamp circuit being operable to use switching operations intrinsic to said lamp to shock-excite a series-connected inductor and capacitor therein into an energy exchange and transfer during each half-cycle of said power source to start and maintain operation of said lamp using only substantially line voltage provided by said power source; and disabling said ignitor in response to an increase of voltage across said ignitor caused by operating of said semi-resonant ballast and lamp circuit.

* * * * *